US007182640B2

(12) United States Patent
Garrett et al.

(10) Patent No.: US 7,182,640 B2
(45) Date of Patent: Feb. 27, 2007

(54) HERMETICALLY SEALED MULTI FEED-THROUGH PIN ELECTRICAL CONNECTOR

(75) Inventors: Vincent W. Garrett, Jacksonville, FL (US); Edward A. Taylor, 905 Rosalind Pl., West Melbourne, FL (US) 32904; James G. Petri, West Melbourne, FL (US)

(73) Assignees: SRI Hermetics, Inc., Melbourne, FL (US); Edward A. Taylor, Melbourne, FL (US)

( * ) Notice: Subject to any disclaimer, the term of this patent is extended or adjusted under 35 U.S.C. 154(b) by 0 days.

(21) Appl. No.: 11/355,272

(22) Filed: Feb. 15, 2006

(65) Prior Publication Data

US 2006/0194476 A1 Aug. 31, 2006

Related U.S. Application Data

(60) Provisional application No. 60/653,361, filed on Feb. 16, 2005.

(51) Int. Cl.
*H01R 13/40* (2006.01)

(52) U.S. Cl. ..... 439/587; 439/271; 29/842

(58) Field of Classification Search ..... 439/271, 439/587; 29/842
See application file for complete search history.

(56) References Cited

U.S. PATENT DOCUMENTS 3,727,169 A * 4/1973 Crane et al. ..... 439/79
5,637,006 A * 6/1997 Almeras ..... 439/191

OTHER PUBLICATIONS

Pacific Aerospace & Electronics, Inc., Document 0-92924, Connector, Micro-D, Low-Profile, Al-Compatible, Release date Oct. 15, 2003, p. 1 of 1.

* cited by examiner

*Primary Examiner*—Truc Nguyen
(74) *Attorney, Agent, or Firm*—Allen, Dyer, Doppelt, Milbrath & Gilchrist, P.A.

(57) ABSTRACT

A multi feed-through pin electrical connector has a pin-count layout that corresponds to the form factor of the pin layout of a micro-size (e.g., nano-type) multipin connector, but contains only a relatively small number of feed-through pins, locations of which are those of selected pins of the micro-sized multipin connector. This allows adjacent pin locations of the relatively small pin-count layout to be spaced farther apart from each other than pin locations of conventional micro-sized multipin connectors, so that the available wire-connection surface areas of the interior ends of the feed-through pins may be substantially increased relative to those of conventional micro-sized multipin connectors, and thereby facilitate secure wire-bonding to the interior ends of the pins.

18 Claims, 7 Drawing Sheets

HERMETICALLY SEALED MULTI FEED-THROUGH PIN ELECTRICAL CONNECTOR

CROSS-REFERENCE TO RELATED APPLICATION

The present application claims the benefit of co-pending U.S. Patent Application Ser. No. 60/653,361, filed Feb. 16, 2005, by Vincent W. Garrett et al, entitled: "Hermetically Sealed Multi-Pin Connector," and the disclosure of which is incorporated herein.

FIELD OF THE INVENTION

The present invention relates in general to very small (e.g., micro-sized) multipin electrical connectors of the type containing a plurality of feed-through pins that are supported and hermetically sealed between a first portion of the connector facing the hermetically sealed interior portion of an electronics-containing housing, and a second portion of the connector exposed to ambient conditions in which the electronics-containing housing is placed. The invention is particularly directed to a multipin electrical connector having a pin-count layout that corresponds to the form factor of the pin layout of a micro-size (e.g., nano-type) multipin connector, but contains only a relatively small number of feed-through pins, locations of which are those of selected pins of the micro-sized multipin connector. This allows adjacent pin locations of the relatively small pin-count layout to be spaced farther apart from each other than pin locations of conventional micro-sized multipin connectors. Increasing the spacing between adjacent pins also allows the size of a respective aperture or bore through the connector, in which a pin is hermetically sealed and supported, to be increased. A larger sized aperture, in turn, means that the diameter of that portion of the pin which passes through the pin support bore, as well as the diameter of the interior end of the pin to which an electrical connection is to be made (as by wire-bonding), can be increased, so that a more robust pin support, hermetic sealing and wire-connection structure may be realized.

BACKGROUND OF THE INVENTION

Manufacturers of certain types of electronics systems, such as infrared (IR) detection and imaging systems, have a need for a hermetically sealed chamber, in which an electronics-containing micro-circuit, such as an infrared-sensing micro-chip that may be internally or externally cooled (depending upon the configuration and application), is placed. In many legacy IR-sensing devices, a cooling fluid, such as liquid nitrogen, supplied from an external cryogenic source, flows through a cooling surface that is situated within a hermetically sealed enclosure. More recently, thermo-electric coolers have been used to cool infrared sensing elements, with both the thermo-electric cooler and the IR-sensing chip cooled thereby being enclosed in a hermetically sealed housing.

Because the multipin plugs that are used to provide external connections for such electronics systems cannot seal to a bundle of wires that connect to the electronics-containing micro-circuits within the hermetically sealed chamber, manufacturers face the problem of having to provide hermetically sealed electrical access to the interior of the housing by means of extremely small multi-pin and socket feed-through connectors. This problem becomes particularly cumbersome and complex with the ongoing demand for reduction in component size.

One type of multi feed-through pin electrical connector, commonly referred to in the industry as a 'micro-D' type multipin connector, which contains a relatively large number (e.g., twenty-five) of closely spaced pins, is diagrammatically illustrated in the cross-sectional side view of FIG. 1. As shown therein, at a front or exterior side of the connector, a respective electrical feed-through pin 10 has an exterior distal end 11 that faces the ambient exterior, from which the interior end 16 of a reduced diameter portion 17 of the pin projecting from the interior side of the connector is hermetically sealed. Extending into the pin 10 from the exterior distal end 11 thereof is a longitudinal socket or bore 15, that is sized to receive and engage a respective pin of an associated external multi-pin (e.g., twenty-five pin) plug 30, two pins of which are shown at 31.

A respective feed-through pin 10 is supported and hermetically sealed within a connector body 13 by a generally cylindrically configured, relatively thin-walled, annular sleeve 12 of dielectric material (such as glass), that is inserted over the reduced diameter portion 17 of the pin from its interior end 16, so as to allow the dielectric sleeve 12 to enter into an annular gap 18 between the reduced diameter portion 17 of the pin 10 and a pin-installation bore 14 through the connector body 13. (The dielectric sleeve 12 cannot be placed around the reduced diameter portion 17 of the pin from its socket side, due to the presence of the socket portion of the pin at distal end 11 thereof.)

By the application of heat, the glass material of the sleeve 12 melts and becomes hermetically sealed with both the outer sidewall of the reduced diameter portion 17 of the pin and the interior sidewall of the pin-installation bore, so that the feed-through pin is thereby captured by, and hermetically sealed and supported within the pin-installation bore. Geometry parameters of such a 'micro-D' type connector include a center-to-center spacing S between adjacent feed-through pins 10 on the order of fifty mils, a bore diameter BD of the pin-installation bore 14 on the order of forty mils, and a reduced diameter RD of the reduced diameter portion 17 of the interior end of the pin on the order of eighteen mils. Because of this very small feed-through pin-sealing geometry, attaching (e.g., bonding) a (small diameter) wire to the interior end 16 of the reduced diameter portion 17 of the pin is a very difficult and labor intensive task.

Typically, bonding a small diameter wire to the interior end 16 of the reduced diameter portion 17 of the pin is accomplished by extending the wire through a stiff capillary tube and impressing the wire against the interior end of the reduced diameter portion of the pin. Then, through the use of ultrasonic energy and the application of heat and pressure, the end of the wire is bonded to the interior end of the pin—forming what is commonly termed as a 'ball bond' at that location. Forming such a ball bond requires the pin to be very stable; if the pin is not stable, it is subject to being deflected or displaced by the application of the ultrasonic energy and pressure, and may result in a poor wire bond, or no bond at all.

This problem of wire-bonding to the interior ends of the reduced diameter portions of such very small sized, feed-through pins has recently become extremely exacerbated by the desire of some equipment manufacturers, such as IR sensor equipment manufacturers, to employ even smaller sized, hermetically sealed, multi-pin connectors, such as 'nano'-type multi feed-through pin electrical connectors, respective exterior and interior perspective views of a respective one of which are diagrammatically illustrated in FIGS. 2 and 3.

In particular, FIG. 2 is a pictorial or perspective front view of the exterior side of a multi feed-through pin, hermetically sealed nano-type connector, depicting pin-receiving sockets 21 of exterior distal ends of a plurality of feed-through pins 20, while FIG. 3 is a perspective interior view of the rear side of the nano-type connector of FIG. 2, depicting reduced diameter portions 23 of respective pins 20 to which wire bonds are to be made. Except for its smaller geometry parameters, a nano-type multi feed-through pin electrical connector has the same cross-sectional configuration as the micro-D type connector of FIG. 1; also, like a micro-D type connector, a nano-type multipin connector may contain from nine to one hundred (e.g., twenty-five) feed-through pins.

The geometry parameters of a nano-type multipin connector include a center-to-center spacing between adjacent pins 20 on the order of only 25 mils (namely, half that (fifty mils) of a micro-D sized connector) and a pin-installation bore diameter on the order of only twenty-two mils (approximately only half that (forty mils) of a micro-D sized connector). The diameter of the distal, socket portion of the feed-through pin of a nano-type connector is on the order of only eighteen mils, in order to conform with the geometry parameters of an associated nano-type plug through which external connections are provided. As a consequence, that portion of the pin which passes through the pin-installation bore must be even narrower, in order to accommodate a reduced wall thickness, annular dielectric sleeve through which hermetic sealing and support for the pin within the pin-installation bore is provided. To this end, the diameter of the reduced diameter portions 23 of the interior ends of the feed-through pins 20 of a nano-type connector is only twelve mils, which makes the pins too flimsy for effectively bonding at these locations.

Because of these very small geometry-based structural support and wire bonding problems, end users now are forced to use larger connectors, in order to have a pin diameter to which they can wire bond. Many manufacturers cannot build their products as small as they desire because a connector with a suitable interior pin diameter is too large for the proposed smaller unit design. A nano connector, which normally would hold twenty-five pins, but which has only nine pins, is much smaller than a normally populated nine pin micro-D connector. Also, manufacturers want to use standard connectors—often military standard connectors—and the available standards for multi-pin rectangular connectors are the sub-D connector standard with a 0.100" pin spacing, the micro-D connector standard with a 0.050" pin spacing, and the nano connector standard with a 0.025" pin spacing.

When users/customers of these types of connectors reach the size limit of their device, because of the size limit of the micro-D connector, they become frustrated, because they know the nano connector exists, but they do not want to use it because of the smaller pin-to-wire required bond, its increased cost (due to the difficulty of building a part with 0.025" pin centers), and its inferior hermetic reliability (due to marginal seal geometry).

SUMMARY OF THE INVENTION

In accordance with the present invention, the above-described problem of wire-bonding to the extremely small sized interior ends of the feed-through pins of a hermetically sealed multi-pin connector is successfully addressed by taking advantage of the above-referenced, reduced pin-utilization technique. Because only a relatively small number of the available feed-through pins of the multipin connector are utilized, the area of that portion of the connector occupied by the unused pins is available to increase the relative separations among the relatively small number of pins to which wire bonds are to be made. As a result, the dimensions of the pin installation bores through the connector body, as well as the dimensions of the interior ends of the pins where wire-bonds are to be made, can be effectively increased. This serves to improve the stability and wire-bonding surface area of the connector's feed-through pins, thereby relaxing the wire manipulation tolerance requirements of the wire bonding tool, and facilitating the formation of secure 'ball bonds' of electrical wires to the interior ends of the feed-through pins, as intended.

To allow for an increase in the size of the interior end portions of the feed-through pins, the pin count of the (twenty-five) pin layout of a conventional nano-type multipin connector, such as that shown in FIGS. 2 and 3, described above, is reduced, to realize a relatively small or reduced pin-count layout, having a form factor that corresponds to the form factor of the (twenty-five) pin layout of the conventional nano-type multipin connector shown in FIGS. 2 and 3, but contains only a relatively small number of feed-through pins, such as only nine pins as customarily employed by IR sensor equipment manufacturers. The locations of respective ones of this relatively small or reduced number of feed-through pins are the same locations as selected ones of the larger number of pins of the (twenty-five) pin layout of the conventional nano-type connector of FIGS. 2 and 3, so that socket-containing distal end portions of the small number of feed-through pins will be aligned with and readily receive and engage respective ones of a like reduced number of pins of an associated external (twenty-five pin) plug.

The pin locations of the reduced number of pins of the multipin connector of the invention are selected so as to space adjacent ones of the pins sufficiently far apart from each other to allow the dimensions (available wire-bonding surface areas) of the interior ends of the pins to be substantially increased, relative to those of conventional very small geometry multipin connectors, such as nano-type connectors. As pointed out above, increasing the spacing between adjacent pins also allows the size of a respective aperture or bore through the connector, in which a pin is hermetically sealed and supported, to be increased. A larger sized aperture, in turn, means that the diameter of that portion of the pin which passes through the pin support bore, as well as the diameter of the interior end of the pin to which an electrical connection is to be made (as by wire-bonding), can be increased, so that a more robust pin support, hermetic sealing and electrical connection (wire-bonding) structure may be realized.

These features of the invention mean that a reduced pin-count nano connector configured in accordance with the invention (e.g., a twenty-five position shell having only nine pins) will be much smaller than a nine pin micro-D connector that is currently limiting user device size. Also since such a nano connector has a larger pin-to-wire bond than current micro-D connectors, it is just as reliable, as the invention uses exactly the same seal geometry as current micro-D connectors and this not only enables the user to realize all the features he desires for no increased cost, but allows the nano connector of the invention to readily mate with a standard, off-the-shelf, low cost plug connector, that conforms to a military standard.

Because the (increased separation) regions between adjacent ones of the reduced number of feed-through pins of the multipin connector of the invention are void of pins, the remaining ones of the (twenty-five) pins of the external plug effectively become 'dummy' pins, which are readily physically accommodated within the empty spaces between adjacent pins, as the external plug is brought into engagement with the connector.

In accordance with a preferred embodiment, a respective feed-through pin of the multipin connector of the invention is supported and hermetically sealed within a generally cylindrical aperture or bore, which may have a diameter on the order of thirty to forty mils, formed through a location of the connector body where the pin of a conventional very small geometry multipin connector, such as a (twenty-five pin) nano-type connector, would normally be supported. The feed-through pin has a first interior, 'dumbbell'-shaped end portion, which may have a diameter on the order of thirty-five mils and a thickness on the order of forty mils, so that the dumbbell-shaped end portion of the pin axially projects from an interior side of the connector body. The increased diameter dimension (e.g., thirty-five mils) of the dumbbell-shaped end portion of the feed-through pin is considerably larger than the very small diameter (e.g., twelve mils) of the wire-bonding surface of the interior end of a conventional feed-through pin of a nano-type connector, and thereby substantially increases the available area of the pin's interior end surface for securing a wire by way of a robust 'ball bond' at that location.

Extending from the increased diameter, dumbbell end portion of the pin, and passing through the bore of the connector body is a reduced diameter, generally longitudinal socket or bore-containing portion of the pin. The reduced diameter portion of the pin may have a diameter on the order of eighteen mils, and readily mates with a respective pin of an associated standard (nano-type) plug. Because the narrowest diameter portion of the feed-through pin architecture of the invention (the eighteen mil diameter of the pin's socket portion, which passes through the hermetic sealing and pin-installation bore) is fifty percent larger than the twelve mil diameter of the narrowest diameter portion of the feed-through pin architecture of a conventional nano-type connector, the feed-through pin of the invention is more electrically robust, as it is able to pass a larger current than a conventional nano-type connector.

With the feed-through pin bore having a diameter on the order of forty mils and the reduced diameter portion of the pin having a diameter on the order of eighteen mils, a substantial annular gap, having a width on the order of eleven mils on either side of a diameter slice through the socket-containing portion of the pin, is provided between the outside of the socket-containing portion of the pin and the sidewall of the bore. This increased sized annular gap provides for the insertion of a generally cylindrically configured, annular sleeve of hermetic sealing material, such as glass, between the pin and the sidewall of the feed-through pin bore, so that the pin may be robustly supported and hermetically sealed within the body of the connector.

The locations of the pins may be selected such that the resulting pin layout provides a substantially spatially periodic array of the pins, in which spacing between adjacent pins has been effectively maximized. Maximizing separations between adjacent ones of the feed-through pins serves to ensure that the pins are spaced sufficiently far apart from each other to accommodate the increased dimensions of the wire-bonding end surfaces of the interior dumbbell end portions of the pins, and facilitate secure wire-bonding to the pins. Moreover, because the locations of the feed-through pins of the multipin connector of the invention correspond to exact locations of selected ones of the larger number of pins (e.g., twenty-five pins) of the conventional nano-type connector, the socket-containing portions of the feed-through pins will be aligned with and thereby readily receive and engage respective ones of a like reduced number of the pins of an associated external (twenty-five pin) plug. As noted above, the remaining ones of the (twenty-five) pins of the external plug become 'dummy' pins, and are physically accommodated within the empty spaces between the pins, as the external plug is plugged into the pin at the external side of the connector.

DETAILED DESCRIPTION

As described above, the present invention takes advantage of a reduced pin-utilization technique practiced by users of very small geometry multi feed-through pin electrical connectors (such as nano-type multi feed-through pin electrical connectors), and the desire of users to make their electrical devices smaller, in order to realize a multi feed-through pin electrical connector architecture having a reduced number of feed-through pins, separations between and bonding surface areas of which are substantially increased relative to those of conventional very small geometry multipin connectors. In particular, the invention takes advantage of the practice of IR equipment manufacturers of utilizing only a reduced number (e.g., nine) of an available larger number (e.g., twenty-five) pins of any one very small geometry (e.g., nano-type) multipin connector for feed-through connections. As pointed out above, if more than this reduced number of connections are required, the user will employ an additional multipin connector (e.g., another like twenty-five pin nano-type connector), again with a maximum utilization of only the reduced number (e.g., nine) of the available (twenty-five) pins of the additional connector.

Because connections are made to only a relatively small number (e.g., nine) of the available (e.g., twenty-five) pins of the connector, the size of that portion of the connector occupied by the remaining unused pins becomes available to increase the relative spacings or separations among those pins to which wire (ball) bonds are to be made. As a consequence, the dimensions of the pin installation bore through the connector body, as well as the dimensions of the interior ends of the pins where wire-bonds are to be made, can be effectively increased. This results in improved stability and wire-bonding surface area of the connector's feed-through pins, thereby relaxing the wire manipulation tolerance requirements of the wire bonding tool, facilitating the formation of secure connections of electrical wires to the interior ends of the feed-through pins, as intended.

Figure 1:
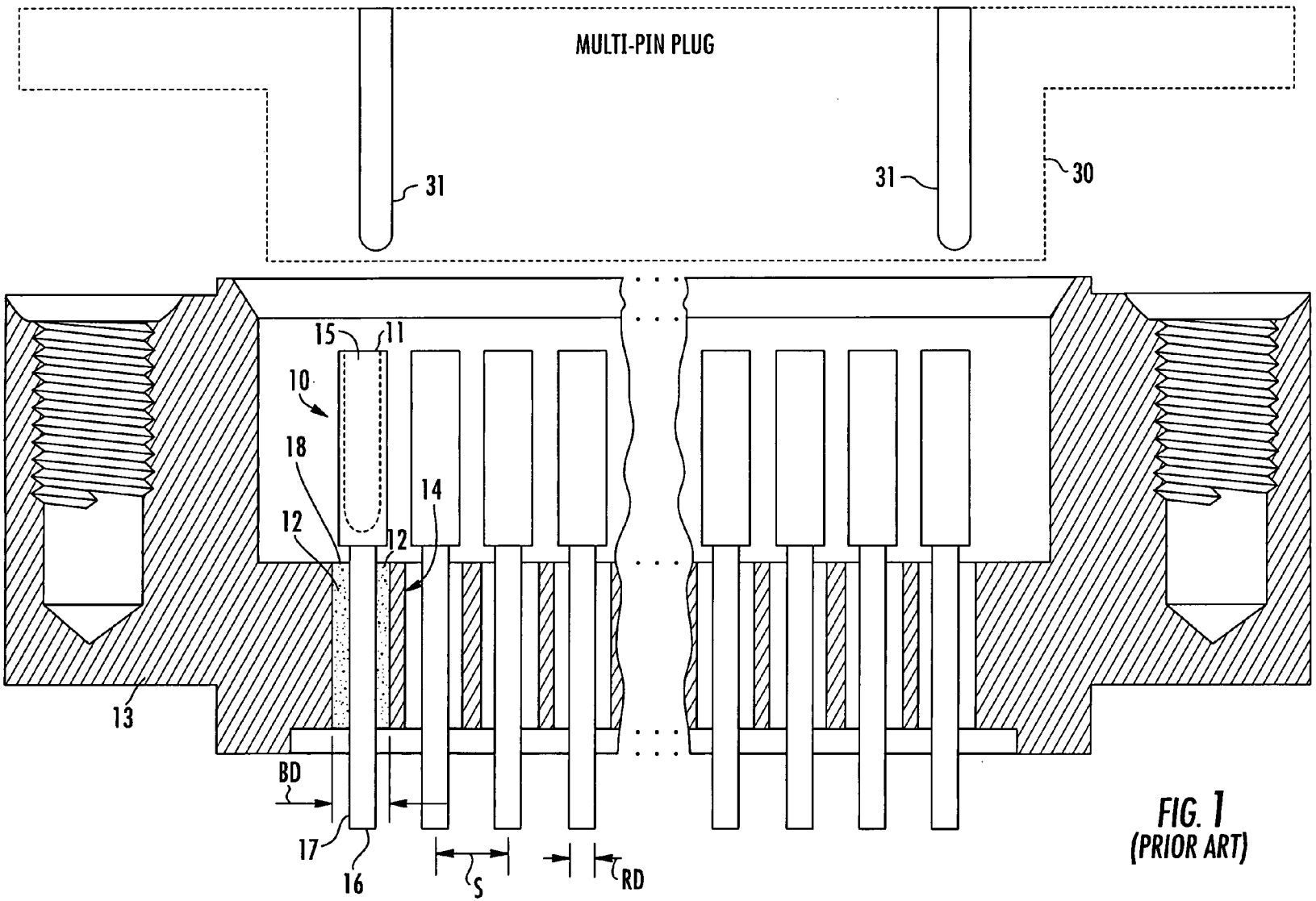
FIG. 1 (PRIOR ART)
FIG. 1 is a diagrammatic cross-sectional, side view illustration of a conventional hermetically sealed, 'micro-D' type multi feed-through pin electrical connector.
Figure 2:
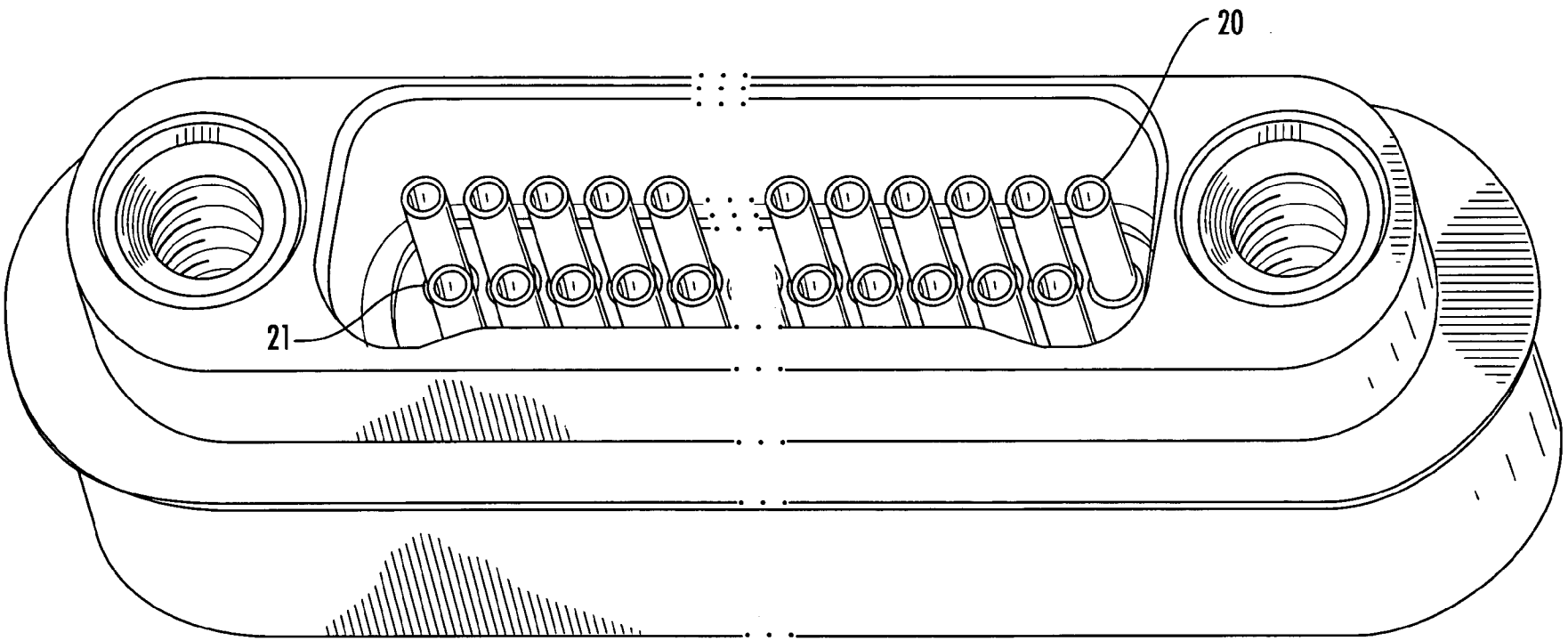
FIG. 2 (PRIOR ART)
FIG. 2 shows a pictorial front view of a conventional hermetically sealed, nano-type multi feed-through pin electrical connector.
Figure 3:
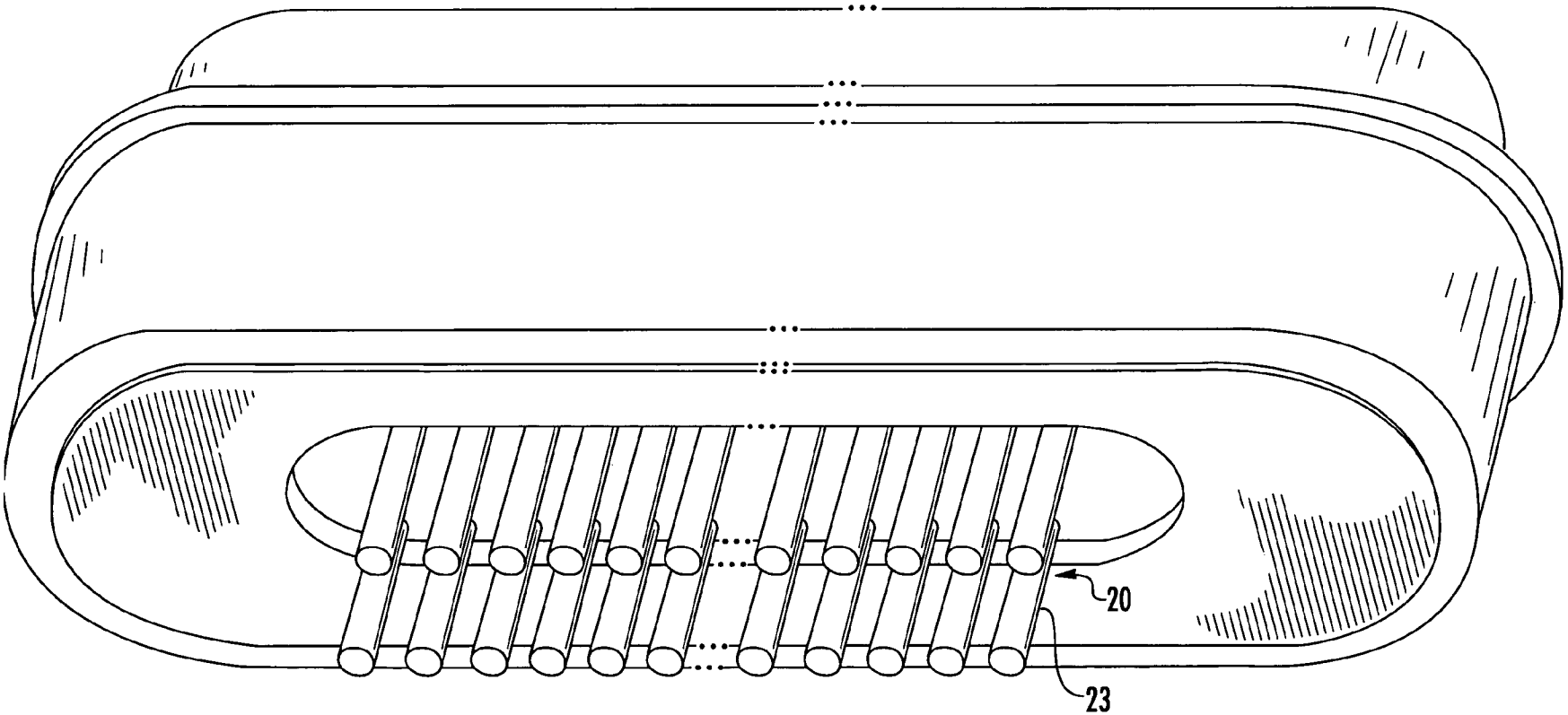
FIG. 3 (PRIOR ART)
FIG. 3 shows a pictorial rear or back view of a conventional hermetically sealed, nano-type feed-through pin electrical connector, a front view of which is shown in FIG. 2.
Figure 4:
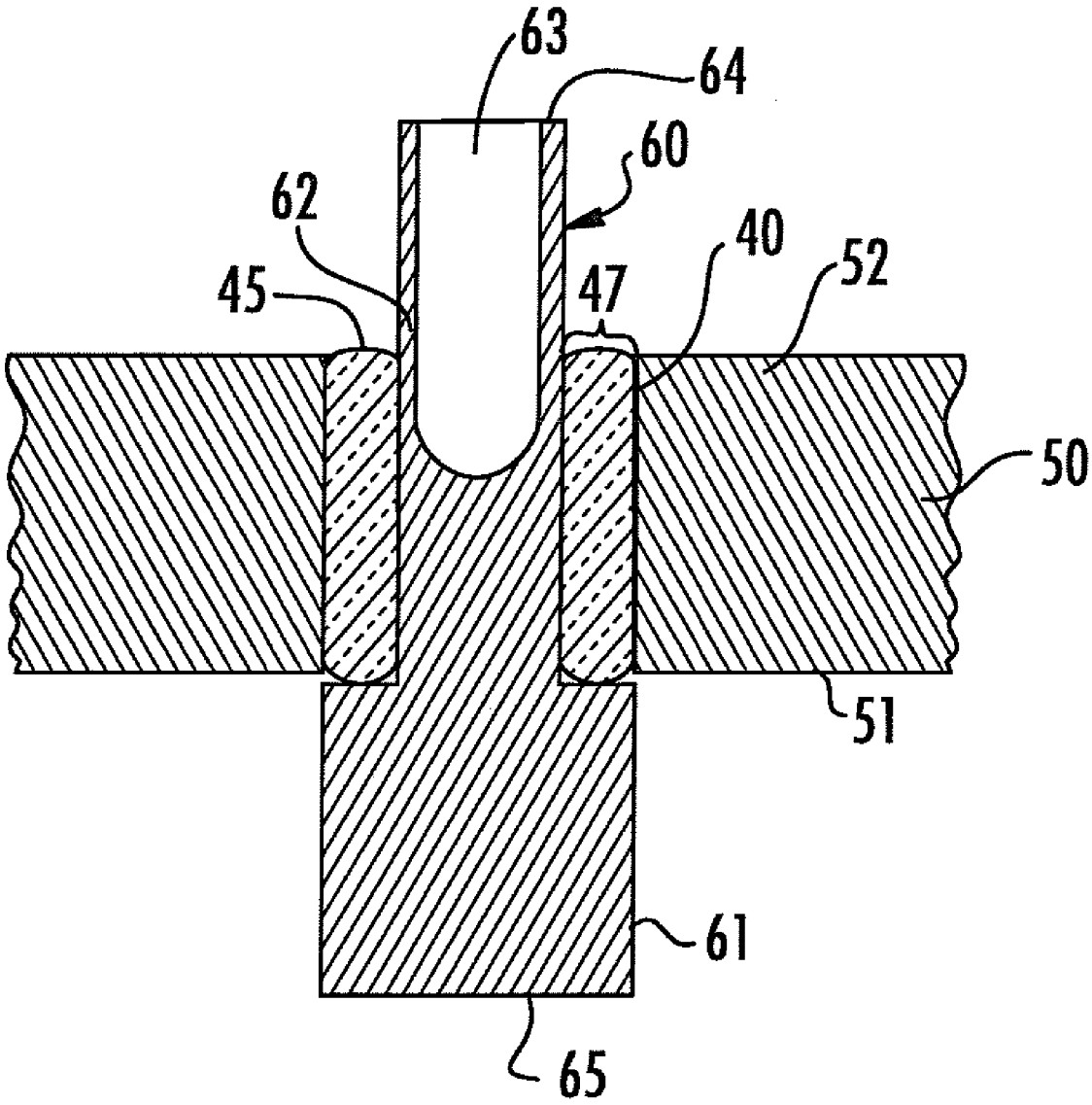
FIG. 4 is a diagrammatic cross-sectional side view of an individual feed-through connector pin employed in the hermetically sealed, multi feed-through pin electrical connector of the present invention.

To this end, the configuration of an individual feed-through pin of a conventional hermetically sealed, multipin electrical connector of the type shown in FIGS. 1–3, wherein the distal end of a respective feed-through pin at the exterior side of the connector has a diameter larger than that of the opposite end portion of the pin at the interior side of the connector, where a wire bond is to be made, is changed to the feed-through pin configuration shown in the diagrammatic cross-sectional side view of FIG. 4, wherein the size of the interior end portion of a respective feed-through pin is substantially larger than the size of the exterior distal end of the pin, so as to ensure successful bonding of a wire to the interior end portion of the feed-through pin, as intended.

Figure 5:
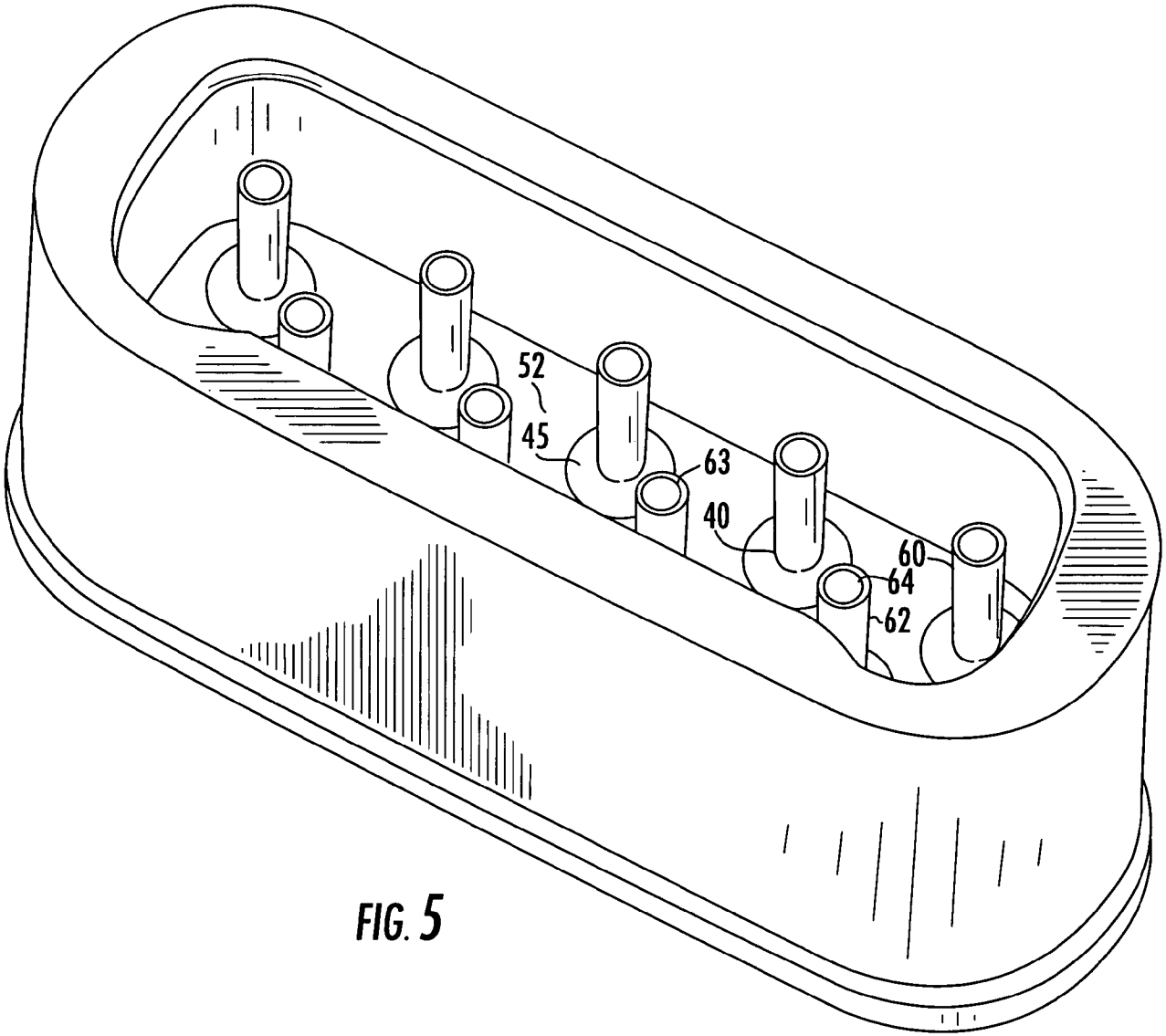
FIG. 5 is a pictorial view of the exterior or front side of the hermetically sealed, multi feed-through pin electrical connector of the present invention.
Figure 6:
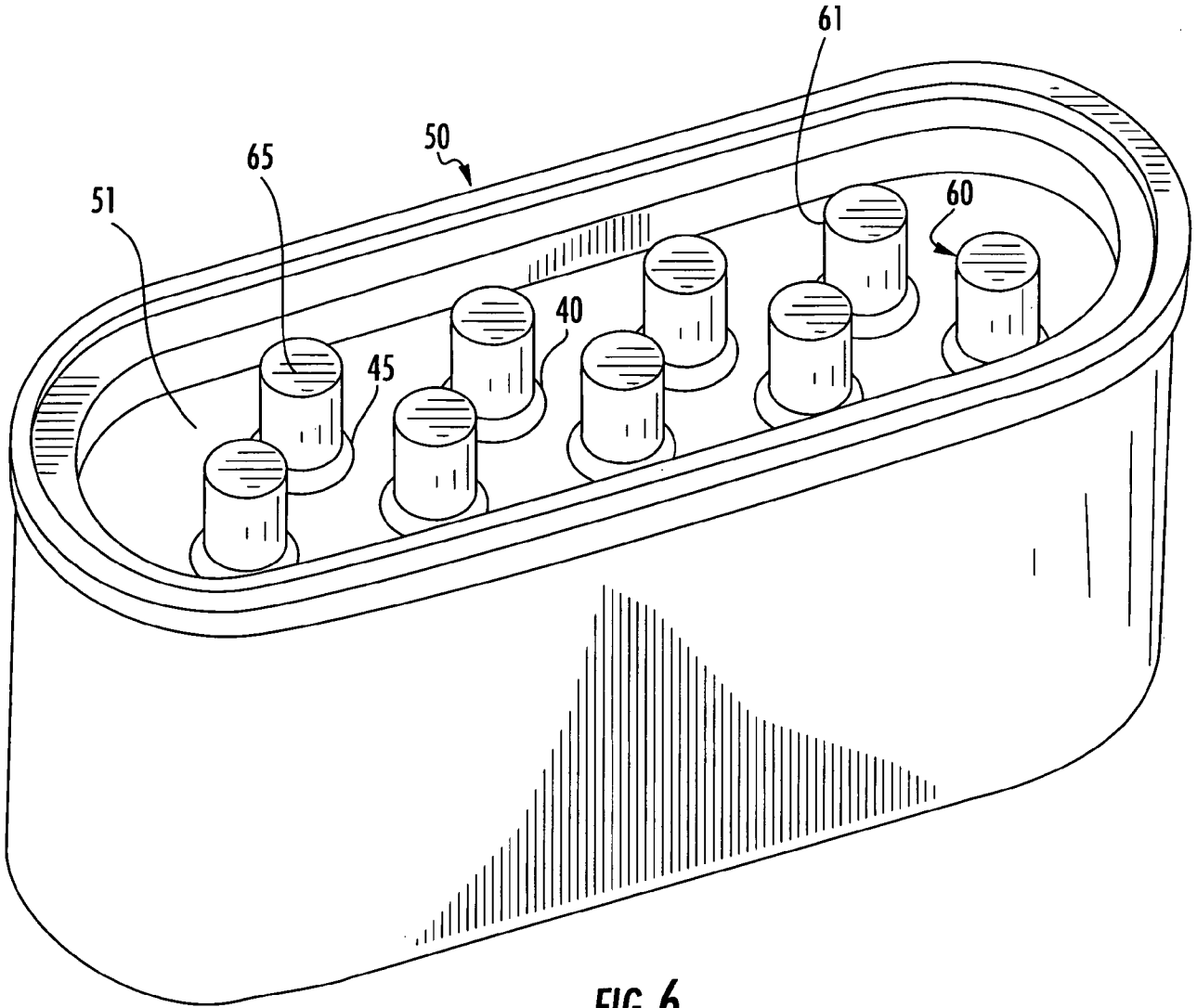
FIG. 6 is a pictorial view of the interior or back side of the hermetically sealed, multi feed-through pin electrical connector of the present invention, a front view of which is shown in FIG. 5.

To allow for this increase in the size of the interior end portions of the feed-through pins, the (twenty-five) pin layout of the nano-type multipin connector shown in FIGS. 2 and 3 is changed to a reduced pin-count layout, such as that shown in the pictorial front and rear views of FIGS. 5 and 6, respectively. This reduced pin layout of the multi feed-through pin electrical connector of the invention has a form factor that corresponds to the form factor of the (twenty-five pin) layout of the nano-type multipin connector shown in FIGS. 2 and 3, but contains a reduced number (e.g., only nine), optimally spaced apart, feed-through pins. In addition, the configuration of a respective feed-through pin of the connector of the invention is changed to that shown in FIG. 4.

By optimally spaced apart is meant that the pin-to-pin spacing of the reduced pin layout, resulting from the selection of feed-through pin locations within the (twenty-five) pin layout of a conventional very small geometry (e.g., nano type) multipin connector, will both provide the desired reduced number of pins (e.g., nine pins), and geometrically place respective ones of the reduced number of pins feed-through pin locations within the (twenty-five) pin layout of the conventional very small geometry (e.g., nano-type) multipin connector, that are spaced sufficiently far apart from each other to allow the dimensions (available wire-bonding surface areas) of the interior ends of the feed-through pins to be substantially increased, relative to those of the pins of conventional very small geometry multipin connectors, so as to facilitate secure wire-bonding to the pins. Namely, the locations of individual ones of the reduced number of feed-through pins of the multipin connector of the invention shown in FIGS. 5 and 6 correspond to exact locations of selected ones of the larger number of pins (e.g., twenty-five pins) of the conventional nano-type connector of FIGS. 2 and 3.

Since the locations of the feed-through pins of the multipin connector of the invention shown in FIGS. 5 and 6 are the same as those of the feed-through pins of the conventional nano-type connector of FIGS. 2 and 3, the sockets of the exterior distal ends of the reduced number of feed-through pins of the multi feed-through pin electrical connector of the invention will be aligned with and thereby readily receive and engage respective ones of a like reduced number of the pins of an associated external (twenty-five pin) plug. Moreover, because the (increased) separations between respective ones of the reduced number of feed-through pins of the multipin connector of the invention are void of feed-through pins, the remaining ones of the (twenty-five) pins of the external plug effectively become 'dummy' pins; these dummy pins are readily physically accommodated within the empty spaces between the reduced pin count, multi feed-through pin connector of the invention, as the external plug is brought into engagement with the connector.

It should be noted that although the embodiment of the invention shown in FIGS. 4–6 depicts a connector having nine feed-through pins, locations of which are aligned with respective pins of a twenty-five pin nano-type connector and pins of an associated twenty-five pin plug, it is to be understood that the present invention is not limited to a connector having this or any other particular number of feed-through pins, nor is the invention limited to use with a connector or plug having a specific number of pins (e.g., twenty-five pins). The nine pin connector embodiment described herein is for the purpose of providing a non-limiting example of the invention for a practical user application—in particular, to both satisfy the need of IR equipment manufacturers to provide hermetically sealed electrical access to the interior of a housing containing infrared-sensing micro-circuitry by way of an extremely small multipin and socket feed-through connector, and conform with the practice of such manufacturers of utilizing only nine of the twenty-five pins of a nano-type multipin connector for the purpose, as described above.

Attention is now directed to the diagrammatic cross-sectional side view of FIG. 4, which illustrates the configuration of an individual feed-through connector pin employed in the hermetically sealed, multi feed-through pin electrical connector of the present invention. As shown therein, a generally cylindrical aperture or feed-through pin bore 40, which may have a diameter on the order of 30-forty mils, as a non-limiting example, is formed at that portion of an electrically conductive connector body 50, such as stainless steel, where one of the pins of a multipin (e.g., nano-type) connector would normally be supported. The bore 40 is sized to support and hermetically seal therein a respective feed-through pin 60.

The feed-through pin 60 itself has a first interior, 'dumbbell'-shaped end portion 61, which may have a diameter on the order of 35 mils and an axial thickness on the order of forty mils, as a non-limiting example, so that the dumbbell-shaped end portion 61 of the pin 60 axially projects (by the extent of its thickness (e.g., forty mils)) from an interior side 51 of the connector body 50. The substantial diameter dimension (e.g., 35 mils) of the dumbbell-shaped end portion 61 of feed-through pin 60 is considerably larger than the extremely small (twelve mil) diameter of the wire-bonding surface of the interior end of a conventional feed-through pin of a nano-type connector, described above, and thereby substantially increases the available area of the pin's interior end surface 65, to which a wire bond may be formed. As noted above, this serves to facilitate the formation of a secure connection (e.g., ball-bond) between a wire and the interior dumbbell-shaped end portion 61 of the pin 60, as intended.

Extending from the dumbbell end portion 61 of the pin 60, and passing through the feed-through pin bore 40 of the connector body 50 is a reduced diameter, generally longitudinal socket or bore-containing portion 62 of the pin. The socket-containing portion 62 of the pin 60 may have a diameter on the order of eighteen mils, as a non-limiting example. A longitudinal bore or socket 63, which may have a diameter on the order of twelve mils, so as to be sized to receive and engage a respective twelve mil width pin of an associated external plug (not shown) for engaging a nano-type connector, is coaxial with and formed into the exterior distal end 64 of the generally longitudinal socket or bore-containing portion 62 of the feed-through pin 60.

The socket-containing portion 62 of feed-through pin 60 is supported and hermetically sealed within the bore 40 through the connector body 50 by means of a generally cylindrically configured, annular sleeve 45 of dielectric material (such as glass). The glass sleeve 45 is readily inserted over the socket-containing portion 62 of the pin 60 from its exterior distal end 64, in order to allow the dielectric sleeve 45 to enter into an annular gap 47 between the outside of the socket-containing portion 62 of the pin 60 and the sidewall of the bore 40, thereby facilitating assembly of the connector's components. The socket-containing portion 62 of pin 60 is preferably coaxial with the bore 40, and projects therefrom beyond the exterior surface 52 of the connector body 50.

With the pin-installation bore 40 having a diameter on the order of forty mils and the reduced diameter portion 62 of the pin 60 having a diameter on the order of eighteen mils, a substantially increased size annular gap 47, having a width on the order of twenty-two mils (i.e., eleven mils on either side of a diameter slice through the socket-containing portion 62 of pin 60), is provided between the outside of the socket-containing portion 62 of the pin 60 and the sidewall of the bore 40. This increased diameter annular gap readily accommodates the insertion of a relatively thick-walled sleeve 45 of hermetically sealing dielectric material between the pin 60 and the sidewall of the feed-through pin bore 40, so that the pin 60 may be robustly physically supported and hermetically sealed within the body of the connector. Moreover, because the narrowest diameter portion of the feed-through pin architecture of the invention (the eighteen mil diameter of the pin's socket portion 62, which passes through the hermetic sealing-and installation bore 40) is fifty percent larger than the twelve mil diameter of the narrowest diameter portion of the feed-through pin architecture of a conventional nano-type connector, the feed-through pin of the invention is more electrically robust, as it is able to pass a larger current than a conventional nano-type connector.

Figure 7:
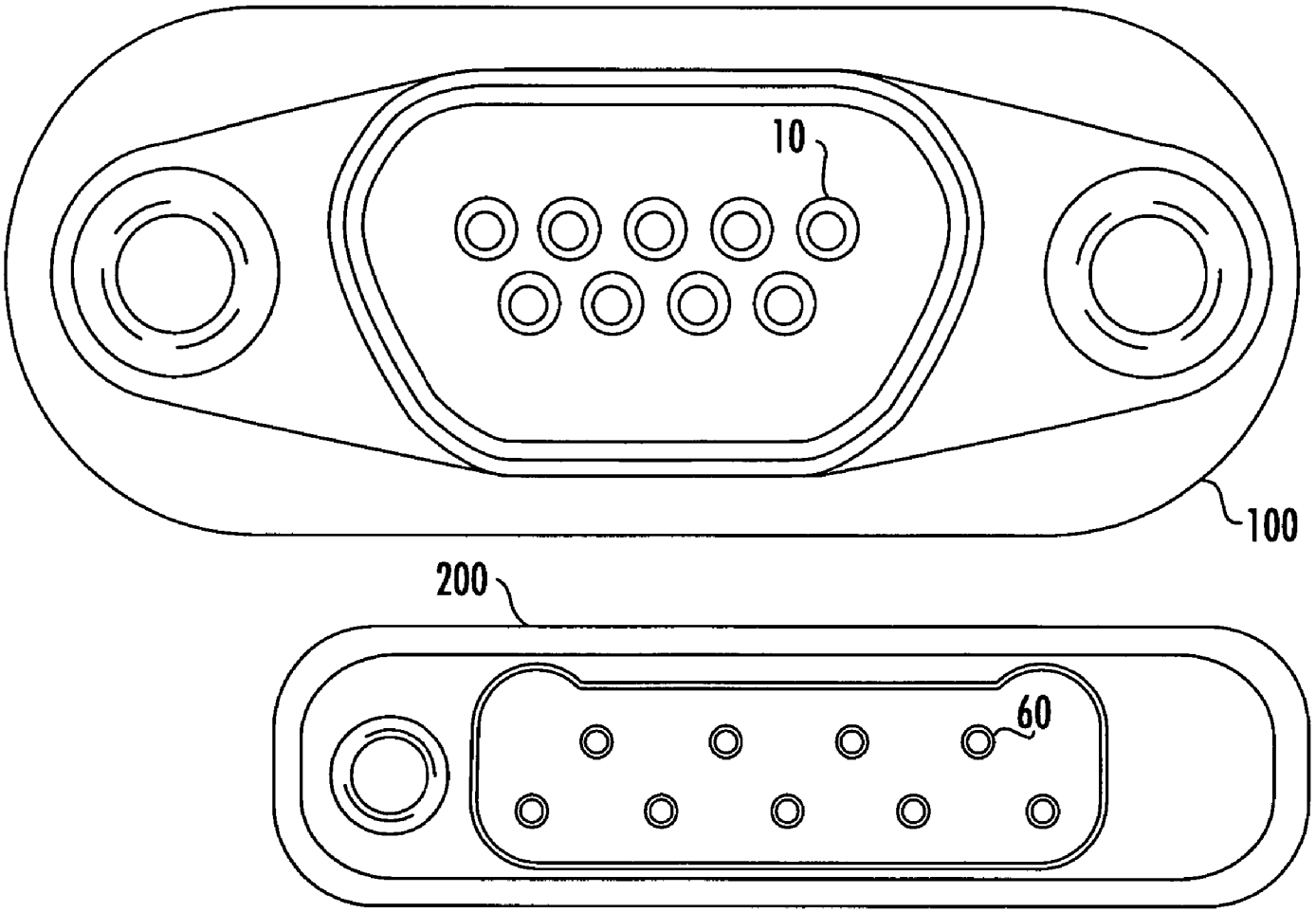
FIG. 7 is to-scale representation of the exterior of front sides of each of a nine pin standard micro-D connector and a reduced pin-count, normally twenty-five position, nano-type connector of FIG. 5.

As pointed out above, and as will be appreciated from a comparison of the respective pin layouts of the conventional nano-type connector shown in FIGS. 2 and 3 and the reduced pin-count multipin connector of the connector of the present invention shown in FIGS. 5 and 6, the reduced pin layout of the multi feed-through pin electrical connector of the invention has a form factor that corresponds to the form factor of the (twenty-five) pin layout of the conventional very small (nano-type) multipin connector shown in FIGS. 2 and 3, and has the pins 60 thereof geometrically placed at the same locations of selected ones of the feed-through pins 20 of the (twenty-five) pin layout of the conventional very small geometry (e.g., nano-type) multipin connector. In addition, FIGS. 5 and 6 illustrate an example of the manner in which the locations of pins 60 may be selected such that the resulting pin layout provides a substantially spatially periodic array of the pins, in which spacing between adjacent pins has been effectively maximized, while FIG. 7 is a to-scale illustration of the exterior or front side of a nine pin standard micro-D type connector 100, and a reduced (nine) pin-count, normally twenty-five position, nano-type connector 200 of FIG. 5. Maximizing separations between adjacent ones of the feed-through pins 60 serves to ensure that the pins are spaced sufficiently far apart from each other to accommodate the increased dimensions of the wire-bonding end surfaces 65 of the interior dumbbell end portions 61 of the pins, shown in FIG. 6, and facilitate secure wire-bonding to the pins. Namely, as described above, a standard nano-type multipin connector has a center-to-center spacing on the order of only 25 mils, and the diameter of a feed-through pin of such a nano-type connector is only 12 mils. This leaves a very narrow differential spacing of only 13 mils to accommodate the socket portions of adjacent feed-through pins of a conventional nano-type connector. Such a very narrow differential spacing would not allow use of the feed-through connector pin of the present invention shown in FIG. 4, wherein the radius of the dumbbell-shaped end portion 61 of the pin 60 is 35/2 mils, or 17.5 mils, which is greater than the conventional 13 mil differential spacing referenced above. However, even though the end portion 61 of the pin 60 has a size that effectively overlaps the separation or spacing between adjacent feed-through pins of a conventional nano-connector, because of the reduced pin-count of the connector pin layout shown in FIGS. 5 and 6, the spacing between adjacent pins of the connector of the present invention is increased relative to that of the prior art, so that such increased spacing can readily accommodate the wider diameter (35 mil width) of the end portion 61 of each pin, and thereby facilitates secure wire-bonding thereto.

Moreover, because the locations of the feed-through pins of the multipin connector of the invention shown in FIGS. 5 and 6 correspond to exact locations of selected ones of the larger number of pins (e.g., twenty-five pins) of the conventional nano-type connector of FIGS. 2 and 3, the socket-containing portions 62 of the feed-through pins 60 will be aligned with and thereby readily receive and engage respective ones of a like reduced number of the pins of an associated external (twenty-five pin) plug. As noted above, the remaining ones of the (twenty-five) pins of the external plug become 'dummy' pins, and are physically accommodated within the empty spaces between the pins 60, as the external plug is plugged into the pin sockets 63 at the external side of the connector, shown in FIG. 5.

As will be appreciated from the foregoing description, the above-described problem of wire-bonding to the interior ends of the feed-through pins of a hermetically sealed, micro-sized multi-pin connector, whose very small pin geometries may be on the order of those of a nano-type multi feed-through pin electrical connector, is successfully addressed by a multi feed-through pin electrical connector architecture having a relatively small pin-count layout, that has a form factor corresponding to that of a conventional (twenty-five) pin layout of a nano-type multipin connector, but containing only a relatively small number of feed-through pins, the locations of which are the same as selected ones of the pins of the (twenty-five) pin layout of the conventional nano-type connector, so as to ensure that socket-containing distal end portions of the feed-through pins of the multipin electrical connector architecture of the invention will be aligned with and engage respective ones of a like reduced number of pins of an associated standard (twenty-five pin) plug, so that the invention may be used with off-the-shelf components.

Having only a relatively small number of feed-through pins allows adjacent pin locations of the relatively small pin-count layout of the multipin electrical connector architecture of the invention to be spaced farther apart from each other than pin locations of conventional very small geometry multipin connectors. As described above, increasing the spacing between adjacent pins allows the size of a respective aperture or bore through the connector, in which a pin is hermetically sealed and supported, to also be increased. A larger sized aperture, in turn, means that the diameter of that portion of the pin which passes through the pin support bore, as well as the diameter of the interior end of the pin to which an electrical connection is to be made (as by wire-bonding), can be increased, so that a more robust pin support, hermetic sealing and connection structure may be realized.

While we have shown and described an embodiment in accordance with the present invention, it is to be understood that the same is not limited thereto but is susceptible to numerous changes and modifications as known to a person skilled in the art. We therefore do not wish to be limited to the details shown and described herein, but intend to cover all such changes and modifications as are obvious to one of ordinary skill in the art.

What is claimed:

1. A multi feed-through pin electrical connector comprising no more than a first number of electrical feed-through conductor elements, hermetically sealed and supported within bores through an electrically conductive connector body, said first number of electrical feed-through conductor elements being distributed within a first pin-count layout having a form factor that corresponds to that of a second pin count layout of a second number of feed-through conductor elements of another multi feed-through pin electrical connector, said first number being less than said second number, locations of said first number of electrical feed-through conductor elements within said first pin-count layout corresponding to locations of selected ones of said second number of electrical feed-through conductor elements within said second pin-count layout of said another multi feed-through pin electrical connector, so that said multi feed-through pin electrical connector contains no electrical feed-through conductor elements other than said first number of electrical feed-through elements, and wherein a respective conductor element of said first number of electrical feed-through conductor elements includes a first, interior end portion, having a first width and projecting from an interior side of said electrically conductive connector body, and a second, exterior end portion, having a second width and projecting from an exterior side of said electrically conductive connector body, and including a generally longitudinal socket that is sized to receive and engage a respective pin of a multi-pin plug, and wherein said first width of said first, interior end portion of said respective conductor element is greater than said second width of said second, exterior end portion of said respective conductor element.

2. The multi feed-through pin electrical connector according to claim 1, wherein geometric spacings between adjacent conductor elements of said first number of electrical feed-through conductor elements within said first pin-count layout are greater than geometric spacings between adjacent conductor elements of said second number of electrical feed-through conductor elements within said second pin-count layout of said another multi feed-through pin electrical connector.

3. The multi feed-through pin electrical connector according to claim 1, wherein said second, exterior end portion of said respective conductor element of said first number of electrical feed-through conductor elements passes into a respective bore through said electrically conductive connector body, and is supported by and hermetically sealed with a sidewall of said respective bore by dielectric material therebetween, and wherein said second, exterior end portion of said respective conductor element extends through said respective bore and is contiguous with said first, interior end portion of said respective conductor element.

4. The multi feed-through pin electrical connector according to claim 1, wherein said multipin plug contains a third number of pins distributed within a third pin-count layout having a form factor that corresponds to that of said second pin count layout of said second number of feed-through conductor elements of said another multi feed-through pin electrical connector, said third number being at least equal to said first number, and wherein locations of said first number of electrical feed-through conductor elements within said first pin-count layout correspond to locations of selected ones of said third number of pins of said third pin-count layout of said multi-pin plug.

5. The multi feed-through pin electrical connector according to claim 1, wherein locations of said first number of electrical feed-through conductor elements within said first pin-count layout are distributed in a substantially spatially periodic array.

6. The multi-feed-through pin electrical connector according to claim 1, wherein said first width of said first, interior end portion of said respective conductor element of said first number of electrical feed-through conductor elements overlaps the spacing between adjacent feed-through conductor elements of said second number of feed-through conductor elements of said second pin count layout.

7. The multi feed-through pin electrical connector according to claim 4, wherein said third number is equal to or less than said second number.

8. In a multi feed-through pin electrical connector having no more than a first number of electrical feed-through conductor elements, that are hermetically sealed and supported within bores through an electrically conductive connector body, the improvement wherein said first number of electrical feed-through conductor elements are distributed within a first pin-count layout having a form factor that corresponds to that of a second pin count layout of a second number of feed-through conductor elements of another multi feed-through pin electrical connector, said first number being less than said second number, locations of said first number of electrical feed-through conductor elements within said first pin-count layout corresponding to locations of selected ones of said second number of electrical feed-through conductor elements within said second pin-count layout of said another multi feed-through pin electrical connector, so that said multi feed-through pin electrical connector contains no electrical feed-through conductor elements other than said first number of electrical feed-through elements, and wherein a respective conductor element of said first number of electrical feed-through conductor elements includes a first, interior end portion, having a first width and projecting from an interior side of said electrically conductive connector body, and a second, exterior end portion, having a second width and projecting from an exterior side of said electrically conductive connector body, and including a generally longitudinal socket that is sized to receive and engage a respective pin of a multi-pin plug, and wherein said first width of said first, interior end portion of said respective conductor element is greater than said second width of said second, exterior end portion of said respective conductor element.

9. The improvement according to claim 8, wherein geometric spacings between adjacent conductor elements of said first number of electrical feed-through conductor elements within said first pin-count layout are greater than geometric spacings between adjacent conductor elements of said second number of electrical feed-through conductor elements within said second pin-count layout of said another multi feed-through pin electrical connector.

10. The improvement according to claim 8, wherein said multi-pin plug contains a third number of pins distributed within a third pin-count layout having a form factor that corresponds to that of said second pin count layout of said second number of feed-through conductor elements of said another multi feed-through pin electrical connector, said third number being at least equal to said first number, and wherein locations of said first number of electrical feed-through conductor elements within said first pin-count layout correspond to locations of selected ones of said third number of pins of said third pin-count layout of said multi-pin plug.

11. The improvement according to claim 8, wherein said first width of said first, interior end portion of said respective conductor element of said first number of electrical feed-through conductor elements overlaps the spacing between adjacent feed-through conductor elements of said second number of feed-through conductor elements of said second pin count layout.

12. A method of configuring a multi feed-through pin electrical connector, so as to facilitate bonding of electrical wires to interior ends of no more than a first number of electrical feed-through conductor elements, that are hermetically sealed and supported within bores through an electrically conductive connector body of said multi feed-through pin electrical connector, said method comprising the steps of:

(a) configuring a respective conductor element of said first number of electrical feed-through conductor elements to include a first, interior end portion, having a first width and projecting from an interior side of said electrically conductive connector body, and a second, exterior end portion, having a second width and projecting from an exterior side of said electrically conductive connector body, and wherein said first width is greater than said second width and is effective to facilitate bonding of an electrical wire to a surface of said first, interior end portion of said respective conductor element;

(b) distributing said first number of electrical feed-through conductor elements within a first pin-count layout of said multi feed-through pin electrical connector, said first pin-count layout having a form factor that corresponds to that of a second pin count layout of a second number of feed-through conductor elements of another multi feed-through pin electrical connector, said first number being less than said second number so that said multi feed-through pin electrical connector contains no electrical feed-through conductor elements other than said first number of electrical feed-through elements; and (c) aligning said first number of electrical feed-through conductor elements within said first pin-count layout with locations of selected ones of said second number of electrical feed-through conductor elements within said second pin-count layout of said another multi feed-through pin electrical connector.

13. The method according to claim 12, wherein step (a) comprises distributing said first number of electrical feed-through conductor elements within said first pin-count layout such that geometric spacings between adjacent conductor elements of said first number of electrical feed-through conductor elements within said first pin-count layout are greater than geometric spacings between adjacent conductor elements of said second number of electrical feed-through conductor elements within said second pin-count layout of said another multi feed-through pin electrical connector.

14. The method according to claim 12, wherein step (a) comprises configuring said second, exterior end portion of said respective conductor element to include a generally longitudinal socket sized to receive and engage a respective pin of a multi-pin plug, said multi-pin plug containing a third number of pins distributed within a third pin-count layout having a form factor that corresponds to that of said second pin count layout of said second number of feed-through conductor elements of said another multi feed-through pin electrical connector, said third number being at least equal to said first number, and step (c) comprises aligning locations of said first number of electrical feed-through conductor elements within said first pin-count layout correspond to locations of selected ones of said third number of pins of said third pin-count layout of said multi-pin plug.

15. The method according to claim 14, wherein step (a) comprises distributing said first number of electrical feed-through conductor elements within said first pin-count layout such that geometric spacings between adjacent conductor elements of said first number of electrical feed-through conductor elements within said first pin-count layout are greater than geometric spacings between adjacent conductor elements of said third number of pins within said third pin-count layout of said multi-pin plug.

16. The method according to claim 15, wherein step (a) comprises inserting said second, exterior end portion of said respective conductor element into a respective bore through said electrically conductive connector body, so that said second, exterior end portion of said respective conductor element extends through said respective bore and is contiguous with said first, interior end portion of said respective conductor element, and supporting and hermetically sealing said second, exterior end portion of said respective conductor element with a sidewall of said respective bore by dielectric material therebetween.

17. The method according to claim 12, wherein step (a) comprises configuring said second, exterior end portion of said respective conductor element to include a generally longitudinal socket that is sized to receive and engage a respective pin of a multi-pin plug, said multi-pin plug containing a third number of pins distributed within a third pin-count layout having a form factor that corresponds to that of said second pin count layout of said second number of feed-through conductor elements of said another multi feed-through pin electrical connector, said third number being at least equal to said first number, and wherein locations of said first number of electrical feed-through conductor elements within said first pin-count layout correspond to locations of selected ones of said third number of pins of said third pin-count layout of said multi-pin plug.

18. The method according to claim 12, wherein said first width of said first, interior end portion of said respective conductor element of said first number of electrical feed-through conductor elements overlaps the spacing between adjacent feed-through conductor elements of said second number of feed-through conductor elements of said second pin count layout.

* * * * *